US005380640A

United States Patent [19]

Kondo et al.

[11] Patent Number: 5,380,640

[45] Date of Patent: Jan. 10, 1995

[54] SILVER HALIDE PHOTOGRAPHIC EMULSION AND SILVER HALIDE PHOTOGRAPHIC LIGHT-SENSITIVE MATERIAL USING THE SAME

[75] Inventors: Toshiya Kondo; Sadayasu Ishikawa, both of Hino, Japan

[73] Assignee: Konica Corporation, Japan

[21] Appl. No.: 185,470

[22] Filed: Jan. 24, 1994

[30] Foreign Application Priority Data

Feb. 10, 1993 [JP] Japan ..... 5-044428

[51] Int. Cl.[6] ..... G03C 1/005

[52] U.S. Cl. ..... 430/567; 430/569

[58] Field of Search ..... 430/567, 569

[56] References Cited

U.S. PATENT DOCUMENTS 5,035,991 7/1991 Ichikawa et al. ..... 430/567
5,238,805 8/1993 Saitou ..... 430/567
5,262,294 11/1993 Yagi et al. ..... 430/567

FOREIGN PATENT DOCUMENTS 484927 5/1992 European Pat. Off. .
509519 10/1992 European Pat. Off. .

*Primary Examiner*—Charles L. Bowers, Jr.
*Assistant Examiner*—Mark F. Huff
*Attorney, Agent, or Firm*—Jordan B. Bierman

[57] ABSTRACT

A silver halide photographic light-sensitive emulsion is disclosed. The emulsion comprises silver halide grains formed under a condition in which fine grains of silver halide are supplied into the protective colloid solution, in which the silver halide grains are formed, in a period in the course of formation of the grains, and the sum of projection area of tabular grains each having a aspect ratio larger than 1.2 accounts for lower than 50% of the total projection area of the whole silver halide grains of the emulsion, and the tabular grains have an average aspect ratio is more than 1.2 and less than 5.0 and an average grain size of not larger than 0.6 μm.

4 Claims, No Drawings

SILVER HALIDE PHOTOGRAPHIC EMULSION AND SILVER HALIDE PHOTOGRAPHIC LIGHT-SENSITIVE MATERIAL USING THE SAME

FIELD OF THE INVENTION

This invention relates to a silver halide photographic emulsion improved in preservation stabilities of sensitivity, graininess and image-sharpness and to a silver halide photographic light-sensitive material formed with the above-mentioned emulsion.

BACKGROUND OF THE INVENTION

In recent years, photographic equipment such cameras and so forth have been popularized, and there have been increased photographic picture-taking opportunities with the use of a silver halide photographic light-sensitive material. Accordingly, there have been more serious demands for making a silver halide photographic light-sensitive material higher in sensitivity and image quality.

One of the dominant factors for making a silver halide photographic light-sensitive material higher in sensitivity and image quality is a silver halide grain. Therefore, research and developments of silver halide grains have so far been aimed at making sensitivity and image quality higher.

However, when making the grain size of silver halide grain smaller for improving image quality, their sensitivity is liable to be lowered, therefore, there has been a limitation in achieving both high sensitivity and high image quality compatible.

For trying to make both sensitivity and image quality higher, techniques for improving a sensitivity/grain size ratio per individual silver halide grain have been studied. As for one of the techniques, a technique in which tabular-shaped silver halide grains are used is described in, for example, Japanese Patent Publication Open to Public Inspection (hereinafter abbreviated to JP OPI Publication) Nos. 58-111935/1983, 58-111936/1983, 58-111937/1983, 58-113927/1983 and 59-99433/1984. When comparing these tabular-shaped silver halide grain to the so-called normal crystal silver halide grain having an octahedral, tetradecahedral or hexahedral crystal form, the former grain has a surface area wider than in the latter when the volume is the same. Therefore, the former grain has an advantage in making a sensitivity higher, because more sensitizing dyes can be adsorbed by the surfaces of silver halide grain.

Also, JP OPI Publication No. 63-92942/1988 describes a technique for putting a core having a high silver iodide content inside a tabular-shaped silver halide grain; JP OPI Publication No. 63-151618/1988 describes a technique for making use of a hexagonal tabular-shaped silver halide grain; JP OPI Publication No. 63-163451/1988 describes a technique for making use of a tabular-shaped silver halide grain having a ratio of the grain thickness to the farthest distance between twinned crystal faces of not less than 5; and each of the techniques display an effect on sensitivity and graininess, respectively.

Further, JP OPI Publication No. 63-106746/1988 describes a technique for making use of a tabular-shaped silver halide grain having a layered structure arranged to be parallel to two principal planes opposite to each other; and JP OPI Publication No. 1-279237/1989 describes a technique for making use of a tabular-shaped silver halide grain having a layered structure substantially partitioned by a plane parallel to two principal planes opposite to each other and also having an average silver iodide content of the outermost layer of at least not less than 1 mol % more than in the whole silver halide grain. Besides the above, JP OPI Publication No. 1-183644/1989 describes a technique for making use of a tabular-shaped silver halide grain having a completely uniform silver iodide distribution of a silver halide including silver iodide.

There are also various image-sharpness improving techniques of which are known in the art. One of the techniques is to prevent rays of light from scattering, and another is to improve an edge effect.

As for the latter techniques, these include a process for making use of a so-called DIR coupler and another process for making use of an unsharp mask. Among these processes, The latter has a practical limitation, because a sensitivity may be lowered and graininess may be deteriorated. As for the former process, numerous processes have been known so far and the useful DIR couplers include the compounds given in, for example, JP Examined Publication No. 55-34933/1980, JP OPI Publication No. 57-93344/1982 and U.S. Pat. Nos. 3,227,554, 3,615,506, 3,317,291 and 3,701,783. However, when emphasizing an edge effect by making use of a DIR coupler, MTF (standing for a modulation transfer function) may be improved in a low frequency range, but any MTF improvement cannot be expected in a high frequency range necessary for high magnification, and such an unfavorable side reaction as a lowered sensitivity and/or density may occur. When making use of a DIR coupler capable of displaying a functional effect over to a long distance, such as so-called diffusible DIR or timing DIR, sensitivity lowering and/or density lowering may be reduced, but an image-sharpness improvement in a highly enlarged image cannot be expected, because an MTF improvable region is further shifted to a lower frequency side.

On the other hand, as the techniques for preventing rays of light from scattering, a process for adding a colored substance, another process for reducing a silver halide content and a further process for thinning a layer have been known. A sharp reduction of a silver coated amount causes a graininess deterioration, because the numbers of dye clouds are reduced. There is a limitation to make a layer thinner by reducing gelatin, a coupler or a coupler solvent contained in a coating solution, because deterioration of coatability and color density are caused. An attempt has been tried since early times to prevent rays of light from scattering and to enhance an image sharpness by adding the foregoing colored substance. For example, there has been a known process for dyeing with a water-soluble dye so that irradiation may be prevented. However, this process is accompanied by an unfavorable side reaction such as a sensitivity lowering and, therefore, this process has been still unable to satisfactorily improve an MTF in a high frequency range.

On the other hand, as the techniques for making use of a grain effective to improve the image sharpness of a silver halide emulsion, there have been techniques for making use of a monodisperse core-shell type emulsion and a tabular-shaped core-shell type emulsion as disclosed in JP OPI Publication Nos. 60-138538/1985 and 60-143331/1985, U.S. Pat. No. 4,444,877 and JP OPI Publication Nos. 59-99433/1984 and 60-35726/1985.

However, these techniques have still been unsatisfactory to display any improved effect.

In a silver halide photographic emulsion, that is prepared in the above-mentioned conventional techniques and is applicable to a common type light-sensitive material or a high image quality light-sensitive material, the preservation stability thereof has not been satisfactory for sensitivity, graininess and image sharpness. In particular, when making use of the tabular-shaped grains for effectively utilizing the merits thereof, the fluctuation in photographic properties do to aging them after carrying out a coating raise a problem. Therefore, the solution of the problem has been desired.

SUMMARY OF THE INVENTION

It is an object of the invention to provide a silver halide photographic emulsion improved in the preservation stability of sensitivity, graininess and image sharpness and to provide a color photographic light-sensitive material containing the above-mentioned silver halide photographic emulsion.

The above object of the invention can be achieved with a silver halide emulsion and a silver halide photographic light-sensitive material using the same. The silver halide emulsion of the invention comprises silver halide grains formed under a condition in which fine grains of silver halide are supplied into the protective colloid solution, in which the silver halide grains are formed, during a period in the course of formation of the grains, and the sum of a projection area of tabular grains each having a aspect ratio larger than 1.2 accounts for not less than 50% of the total projection area of all silver halide grains of the emulsion, and the tabular grains have an average aspect ratio of more than 1.2 and less than 5.0 and an average grain size of not larger than 0.6 μm.

DETAILED DESCRIPTION OF THE INVENTION

In a silver halide emulsion of the invention, the sum of the projection area of tabular-shaped silver halide grains occupies not less than 50% of the total projection area of all silver halide grains in the emulsion. In the invention, the term "tabular-shaped silver halide grain" (that is also referred to as simply tabular grain) is defined as a silver halide grain having an aspect ratio, i.e. ratio of the size to the thickness of the grain, of not less than 1.2. The tabular-shaped grains in the emulsion of the invention have an average grain size of not larger than 0.6 μm and an average aspect ratio of 1.2 to 5.0. The tabular-shaped silver halide grains are crystallographically classified as a twinned crystal.

The term, "a twinned crystal" means a silver halide crystal having one or more twinned faces inside an individual grain. The classifications of the twinned crystal configurations are detailed in, for example, Klein & Moiser, "A Report, 'photographische Korrespondenz'", vol.99, p.99 and, ibid., vol.100, p.57.

In the invention, tabular-shaped silver halide grains occupy, preferably, not less than 60% and, more preferably, not less than 70% of the total projective area of silver halide grains.

In the tabular-shaped silver halide grains of the invention, an average aspect is 1.2 to 5.0, preferably not lower than 1.3, more preferably within the range of not lower than 1.5 to lower than 4.5 and, further preferably within the range of not lower than 2.0 to lower than 4.0. Such an average aspect ratio thereof can be obtained by calculating the average value of the ratios of grain sizes to the thicknesses of the whole tabular-shaped grains.

In the invention, it is preferred that a tabular-shaped silver halide grain have two twinned crystal faces each parallel to the principal plane thereof.

Such a twinned crystal face as mentioned above can be observed through a transmission type electron microscope. The observation can be concretely performed in the following manner. First, a silver halide photographic emulsion is coated on a support so that the principal face of each subject tabular-shaped silver halide grain can be arranged to be approximately parallel to the support, so that a sample is prepared. The resulting sample is sliced by a diamond cutter so as to obtain thin slices each having a thickness of the order of 0.1 μm. Then, the presence of the twinned crystal faces can be confirmed by observing the resulting thin slices through a transmission type electron microscope.

Of the tabular-shaped silver halide grains of the invention, the average grain size thereof is not larger than 0.6 μm, preferably within the range of not smaller than 0.2 μm to not larger than 0.6 μm and, more preferably within the range of not smaller than 0.3 μm to not larger than 0.6 μm.

In the invention, the term, "an average grain size", is herein defined as a grain size ri obtained when maximizing a product of $ni \times ri^3$, in which ni represents a frequency of grains having a grain size ri. Provided that the significant figures are three columns and the lowest column is rounded and that the numbers of grains subject to measurement are 1,000 grains at random.

The term, "a grain size ri", herein stated means a diameter of a circular image having the same area as the area of the projected image of a subject tabular-shaped silver halide grain when observing the grain from the direction vertical to the principal face of the grain.

A grain size ri can be obtained by 10,000 to 70,000 times magnifying and then photographing a tabular-shaped silver halide grain through an electron microscope and by practically measuring the diameter of the printed grains or the projected area thereof.

As for the silver halide photographic emulsions relating to the invention, a polydisperse type emulsion having a relatively wide grain size distribution, a monodisperse type emulsion having a relatively narrow grain size distribution and so forth may be used. Among them, monodisperse type emulsions are preferably used.

When a grain size distribution is defined by the following equation, $$\text{Grain size distribution } (\%) = (\text{Standard deviation}/\text{Average grain size}) \times 100,$$

the above-mentioned monodisperse type emulsion is to have a grain size distribution of not more than 20% and, preferably, not more than 15%.

The above average grain size and standard deviation can be obtained from a grain size ri defined as above.

The silver halide photographic emulsions of the invention can be applied with any silver halide such as silver bromide, silver iodobromide, silver iodochloride, silver chlorobromide, silver chloroiodobromide and silver chloride, each of which may be used in any ordinary silver halide emulsion. Among them, silver bromide, silver iodobromide and silver chloroiodobromide may preferably be applied thereto.

In a silver halide photographic emulsion of the invention, the silver halide grains to be contained therein may be either a grain capable of forming a latent image mainly on the surface thereof or a grain capable of forming a latent image mainly inside the grain.

In the invention and when making use of silver iodobromide, the silver iodide content thereof is to be within the range of, preferably, not less than 2 mol % to not more than 15 mol %, more preferably, not less than 3 mol % to not more than 12 mol % and, particularly, not less than 4 mol % to not more than 10 mol %, in terms of an average silver iodide content of the whole silver halide grain.

In a silver halide photographic emulsion of the invention, the silver halide grains to be contained therein may also be the so-called core/shell type grains concentrating silver iodide inside the grains.

The above-mentioned core/shell type grain is a grain comprising a core as the nucleus and a shell covering the core. The shell can be formed of a single or more layers. It is preferable that the silver iodide content of a core and that of a shell are different from each other.

When making use of a seed grain for forming a silver halide grain of the invention, the seed grain may be either that having a regular crystal form such as a cube, an octahedron and a tetradecahedron, or that having an irregular crystal form such as a spherical form and a tabular form. In such a grain as mentioned above, any ratio of {100} plane to {111} plane may be applicable. The grains may also be any one of the grains either in a compound crystal form or in a variously mixed crystal form. Besides the above, such a monodisperse type spherical seed grain as described in, for example, JP O.P.I. Publication No. 2-408178/1990 may further be used.

A silver halide photographic emulsion containing the tabular-shaped silver halide grains relating to the invention may be prepared in a variety of processes of which have been well-known in the art. For example, a single-jet process, a double-jet process and a triple-jet process may be used in any combination. The above-mentioned processes are also allowed to use in combination with a process for controlling a pH and a pAg of a liquid phase in which a silver halide can be produced.

A silver halide photographic emulsion of the invention may also be prepared in any one of the processes including an acidic process, a neutral process and an ammoniacal process.

In a silver halide photographic emulsion of the invention, tabular-shaped silver halide grains are formed by supplying silver halide grains to an aqueous solution containing a protective colloid in which the silver halide grains are formed, in at least a part of the courses of forming the silver halide grains.

In the invention, the expression, "a course of forming a silver halide grain", means steps in order from a step of producing nuclei of the silver halide grain, a desalting step, a step of dispersing the silver halide grain, further, if necessary, until the end of a chemical sensitizing step and a color sensitizing step, when no seed grain is used; and it means steps in order from a step of growing a grain from the seed grain and so forth as mentioned above. However, the course of forming a silver halide grain does not include a coating solution preparing step, a coating step nor the following steps thereafter.

In the invention, it is preferable to supply a silver halide fine grain prior to a desalting step.

In the invention, the expression, "at least a part of the course of forming a silver halide grain", means any period of time or any point of time in the course of forming the silver halide grain. The above-mentioned period of time may be the whole or a part of the period of forming a silver halide grain. It is also allowed that a plurality of points of time or any periods of time may be made present.

In the invention, any substances capable of forming a protective colloid such as gelatin and others may be used as a protective colloid.

Gelatin capable of serving as the protective colloid may be lime-processed or acid-processed. The details of the gelatin preparation can be referred to, for example, Arthur Weiss, "The Macromolecular Chemistry of Gelatin" (Academic Press, 1964). The substances capable of forming a protective colloid other than gelatin include, for example; a gelatin derivative, a graft polymer of gelatin and other macromolecule, such as proteins including albumin and casein; cellulose derivatives such as hydroxyethyl cellulose, carboxymethyl cellulose and cellulose sulfate; sugar derivatives such as sodium alginate and starch derivatives; and various synthetic or semi-synthetic, hydrophilic, macromolecular substances including, for example, homopolymers or copolymers such as polyvinyl alcohol, polyvinyl alcohol partial acetar, poly-N-vinyl pyrrolidone, polyacrylic acid, polymethacrylic acid, polyacrylamide, polyvinyl imidazole and polyvinyl pyrazole. In the invention, gelatin is preferably used as a protective colloid.

In the invention, silver halide grains can be formed by substantially supplying silver halide fine grain only, or by supplying silver halide fine grain and an aqueous solution of silver salt or a halide as described in JP O.P.I. Publication No. 2-167537/1990. When silver halide grains are formed by substantially supplying silver halide fine grains only, it is also allowed either to use silver halide fine grains having the same composition as the halide composition of a subject silver halide grains being formed, or to use a method for supplying two or more kinds of silver halide fine grains having different halide compositions at the same time in such a proportion that a desired halide composition can be obtained.

When preparing a silver halide photographic emulsion of the invention, silver halide fine grains applicable thereto may be prepared either in advance of or in parallel to the preparation of the silver halide emulsion. In the latter case, the silver halide fine grains may be prepared by making use of a mixing vessel separately provided from a reaction chamber in which the silver halide emulsions are formed as described in, for example, JP O.P.I. Publication Nos. 1-183417/1989 and 2-44335/1990. It is however preferable that a vessel is provided after completing the formation of fine grains for temporarily accumulating the fine grains in which conditions of the fine grain suspension such as pH or pAg value or addenda are controlled so as to meet them to the growing conditions inside a reaction chamber, after which the fine grains are supplied to the reaction chamber, as described in, for example, JP O.P.I. Publication No. 2-314891/1990.

Preferable conditions for preparing the tabular silver halide grains of the invention are as follows.

When seed grains are used for the preparation, the use of the small size seed grains is preferable to form core/shell type grains. The preferable size of the seed grain is 0.03 to 0.25 μm, particularly 0.05 to 0.20 μm.

For preparation of silver halide grains having an aspect ratio of 3.0 or more, a method may also be applied in which formation of nuclei and growth of them are continuously performed without addition of seed grains.

Silver iodide content at the time of nuclei formation is preferably zero to 15 mol %, particularly zero to 10 mol %. The temperature at the time of formation of the nuclei of the grains is preferably 10° C. to 45° C., more preferably 15° C. to 40° C., further preferably not higher than 37° C. The temperature is raised to within the range of 45° C. to 90° C., preferably 50° to 80° C., after completion of formation of the nuclei, for ripening the nuclei. Then the nuclei are grown.

A silver halide solvent can be used in the course of preparation of silver halide grains of the invention. However, it is preferable to use no silver halide solvent for preparing silver halide grains having a high aspect ratio.

The amount of water-soluble silver salt such as silver nitrate for the formation of the nuclei is preferably 0.0001% to 5%, more preferably 0.001% to 3%, of the total amount of the silver salt to be used in the emulsion. The adding time of the soluble silver salt is preferably 1 second to 10 minutes, more preferably 1 second to 5 minutes. The preferable pAg value in the period of the nuclei formation is 8.0 to 10.0, particularly 8.8 to 9.8, and that in the period of growing the grains is 8.0 to 9.5, particularly 8.4 to 9.3.

The processe for preparing the silver halide fine grains relating to the invention is preferably carried out by a process under the acidic or neutral circumstances having a pH≦7.

It is preferable that the silver halide fine grains applicable to the invention are substantially the twinned crystal type having twinned crystal faces.

The term, "substantially silver halide fine grains having twinned crystal faces", means that the proportion of the silver halide fine grains having twinned crystal faces is not less than 70% in number to the whole silver halide fine grains and, preferably, not less than 80% thereto. The twinned crystals can be confirmed by observing them through a transmission type electron microscope in the foregoing method. The numbers of the silver halide fine grains subject to the observation is to be 1,000 grains at random.

For preparing a twinned silver halide grain, water soluble silver salt containing silver ion and water soluble alkaline halide ion containing halide ion are added and mixed while various super-saturation factors are controlled in a range so that the proportion of silver halide fine grains having twinned surface among silver halide fine grains produced is not less than 70% by number.

As examples of super-saturation factors, mixing temperature, gelatin concentration, ion concentration of iodide, pBr, ion supplying speed and the rotation number of stirring are included. Formation of twinned surface is promoted as the iodide ion concentration and the ion supplying speed is higher or larger and mixing temperature, pBr and the rotation number of stirring are lower or smaller. On the other hand, however, the promoted formation of twinned surface is accompanied by a tendency to deteriorate non-uniformity of silver halide fine grains such as deterioration of distribution is advanced and frequency of the appearance of silver halide fine grains having unparalleled multilayer twinned surface. Accordingly, with regard to each factors affecting the degree of supersaturation in the precipitating solution, it is necessary to select conditions so that the formation circumstances of silver halide fine grains produced are appropriate. For details with regard to each super-saturated element, see description in JP OPI Publications No. 63-92942/1988 No. 1-213637/1989.

For inhibiting the silver halide fine grains themselves from producing a reduced silver nucleus, the pAg value for forming the silver halide fine grains applicable to the invention is to be, preferably not lower than 3.0, more preferably not lower than 5.0 and, particularly not lower than 8.0.

When forming the silver halide fine grains, the suitable temperature is not higher than 50° C., preferably not higher than 40° C. and particularly not higher than 35° C. When the silver halide grains are formed in the above-mentioned process, the protective colloids applicable thereto include, for example, the common types of macromolecular gelatin.

When the silver halide fine grains are formed at a relatively low temperature, the progress of an Ostwald's ripening phenomenon produced after completing the formation of the silver halide fine grains can be inhibited. However, the gelatin used therein is liable to gel by making the temperature lower. It is, therefore, preferable to use a low molecular weight gelatin, a synthetic molecular compound capable of displaying a protective colloidal function to silver halide grains or a natural macromolecular compound other than gelatin, as described in, for example, JP OPI Publication No. 2-166442/1990. The concentration of such a protective colloid as mentioned above is, preferably not less than 1% by weight, more preferably not less than 2% by weight and, particularly not less than 3% by weight.

The silver halide fine grains, which are supplied to an aqueous protective colloid-containing solution in which silver halide grains are formed, grow the silver halide grains with the aid of an Ostwald's ripening effect. The silver halide fine grains are readily dissolved because of their fine grain sizes and are then formed again into silver ions, so that the silver halide grains can be uniformly grown up.

The grain size of the silver halide fine grains applicable to the invention is preferably not larger than 0.5 μm.

Halide ions and silver ions each applicable to form the silver halide grains of the invention may be added together at the same time or one of them is added to the place where the other is made present. And, by taking the critical growth rate of silver halide crystals into consideration, the halide ions and silver ions may be added one after another or together at the same time while controlling the pAg and pH of a mixing chamber. Further, the silver halide composition of the grains may be varied in any courses of forming silver halide in a conversion process.

When forming the silver halide grains of the invention, any known silver halide solvent such as ammonia, thioether and thiourea may be made present. Also, in the course of forming and/or growing silver halide grains, at least one kind of the salts selected from the group consisting of a cadmium salt, a zinc salt, a lead salt, a thallium salt, an iridium salt including the complex salts thereof, a rhodium salt including the complex salts thereof and an iron salt including the complex salts thereof may be added so as to contain these metal elements inside and/or on the surfaces of the grains. Further, a reduction sensitization nucleus can be provided to the inside and/or on the surfaces of the grains.

When making a desalting treatment, it can be performed in the method described in Research Disclosure, No. 17643, Article II.

When preparing a silver halide photographic emulsion relating to the invention, the optimum conditions other than the above-mentioned conditions can be selected out with reference to JP OPI Publication Nos. 61-6643/1986, 61-14630/1986, 61-112142/1986, 62-157024/1987, 62-18556/1987, 63-92942/1988, 63-151618/1988, 63-163451/1988, 63-220238/1988 and 63-311244/1988.

The silver halide photographic emulsions of the invention can preferably be applied to a silver halide color photographic light-sensitive material.

The silver halide photographic emulsions of the invention can be physically, chemically and spectrally sensitized. The additives applicable to such a process as mentioned above are given in Research Disclosure Nos. 17643, 18716 and 308119 (hereinafter referred to as RD17643, RD18716 and RD308119, respectively). The pages and articles thereof will be indicated in the following table.

TABLE 1

| (Additive) | (RD308119) | (RD17643) | (RD18716) |
|---|---|---|---|
| Chemical sensitizer | p. 996 III-A | p. 23 | p. 648 |
| Spectral sensitizer | p. 996 IV-A, B, C, D, H, I, J | pp. 23–24 | pp. 648–9 |
| Supersensitizer | p. 998 IV-A–E, J | pp. 23–24 | pp. 648–9 |
| Antifoggant | p. 998 VI | pp. 24–25 | p. 649 |
| Stabilizer | p. 998 VI | pp. 24–25 | p. 649 |

The known photographic additives applicable to the invention are also given in RD17643, RD18716 and RD308119. Table 2 will indicate the pages and articles corresponding thereto.

TABLE 2

| (Additive) | (RD308119) | (RD17643) | (RD18716) |
|---|---|---|---|
| Color staining preventive | p. 1002 VII-I | p. 25 | p. 650 |
| Dye-image stabilizer | p. 1001 VII-J | p. 25 | |
| Whitening agent | p. 998 V | p. 24 | |
| UV absorbent | p. 1003 VIII-C, XIII-C | pp. 25-26 | |
| Light absorbent | p. 1003 VIII | pp. 25-26 | |
| Light scattering agent | p. 1003 VIII | | |
| Filter dye | p. 1003 VIII | pp. 25-26 | |
| Binder | p. 1003 IX | p. 26 | p. 651 |
| Antistatic agent | p. 1006 XIII | p. 27 | p. 650 |
| Layer hardener | p. 1004 X | p. 26 | p. 651 |
| Plasticizer | p. 1006 XII | p. 27 | p. 650 |
| Lubricant | p. 1006 XII | p. 27 | p. 650 |
| Surfactant, coating aid | p. 1005 XI | pp. 26-27 | p. 650 |
| Matting agent | p. 1007 XVI | | |
| Developing agent, (contained in a light-sensitive material) | p. 1011 XX-B | | |

When prepare a color photographic light-sensitive material using the emulsion of the invention, it is allowed to use various couplers in combination. The typical examples thereof are also given in the foregoing RD17643 and RD308119. Table 3 will indicate the pages and articles corresponding thereto.

TABLE 3

| (Additive) | (RD308119) | (RD17643) |
|---|---|---|
| Yellow coupler | p. 1001 VII-D | p. 25 VII-C-G |
| Magenta coupler | p. 1001 VII-D | p. 25 VII-C-G |
| Cyan coupler | p. 1001 VII-D | p. 25 VII-C-G |
| Colored coupler | p. 1002 VII-G | p. 25 VII-G |
| DIR coupler | p. 1001 VII-F | p. 25 VII-F |
| BAR coupler | p. 1002 VII-F | |
| Other useful residual group-releasable coupler | p. 1001 VII-F | |
| Alkali-soluble coupler | p. 1001 VII-E | |

The additives applicable to constitute a silver halide photographic light-sensitive material of the invention may each be added in such a dispersion process as described in RD308119, p.1007, article XIV.

In the invention, it is allowed to use such a support as given in, for example, RD17643, p.28, RD18716, pp.647–648 and RD308119, p.1009, article XVII.

To a silver halide photographic light-sensitive material of the invention, it is allowed to provide an auxiliary layer such as a filter layer and an interlayer each given in, for example, the foregoing RD308119, article VII-K.

To a silver halide photographic light-sensitive material of the invention, it is allowed to provide a variety of layer arrangements including, for example, the normal, reversal and unit layer arrangements such as described in RD308119, VII-K.

A silver halide photographic light-sensitive material of the invention can serve as any one of various color light-sensitive materials including, typically, a color negative film for general or cinematographic use, a color reversal film for slide or TV use, a color paper, a color positive film and a color reversal paper.

For obtaining a dye-image by making use of a light-sensitive material of the invention, the light-sensitive material is exposed to light and is then processed in a commonly known color development process.

A light-sensitive material of the invention can be developed in a common process such as described in the foregoing RD17643, pp.28–29, RD18716, p.615 and RD308119, XIX.

EXAMPLES

EXAMPLE 1

<Preparation of Comparative Emulsion Em-1>

By making use of the following 7 kinds of solutions, a comparative emulsion Em-1 containing tabular-shaped silver halide grains was prepared.

| | |
|---|---|
| (Solution A) | |
| Ossein gelatin | 14.0 g |
| Distilled water | 5700 ml |
| A 10% methanol solution containing sodium polyisopropylene-polyethyleneoxy-disuccinate | 1.4 ml |
| (Solution B) | |
| An aqueous 1.5N silver nitrate solution | |
| (Solution C) | |
| An aqueous 3.5N silver nitrate solution | |
| (Solution D-1) | |
| An aqueous solution containing 1.38N potassium bromide and 0.12N potassium iodide | |
| (Solution E-1) | |
| An aqueous solution containing 3.395N potassium bromide and 0.105N | |

-continued

| | |
|---|---|
| potassium iodide | |
| (Solution F) | |
| Ossein gelatin | 72.0 g |
| Distilled water | 1300 ml |
| (Solution G) | |
| Ossein gelatin | 360 g |
| Distilled water | 3600 ml |

Solutions B and D-1 were added in an amount equivalent to 2% of the whole silver nitrate used therein to Solution A being kept at 35° C. in a reaction chamber in a double-jet precipitation process by taking 3 minutes. In the course of adding them, the pH thereof was controlled to be 2.0 by making use of nitric acid and the pAg thereof was kept at 9.7. Successively, the pH was controlled to be 6.0 by making use of potassium hydroxide and Solution F was then added thereto, so that the mixture was ripened at 60° C. for 10 minutes. Then, Solutions B and D-1 were added in an amount equivalent to 28% of the whole amount of silver nitrate used therein by taking 25 minutes in a double-jet precipitation process while keeping the pAg at 9.0. Further, after adding Solution G, the mixture was ripened for 10 minutes. Then, Solutions C and E-1 were added in an amount equivalent to 70% of the whole amount of silver nitrate used therein by taking 50 minutes in a double-jet precipitation process while keeping the pAg at 8.6. At that time, the whole amount of silver nitrate used therein was 1200 g.

Successively, after a desalting treatment was carried out in accordance with the method described in JP O.P.I. Publication No. 5-72658/1993, gelatin was added and then the emulsion blocks were redispersed. The pH and pAg of the dispersed emulsion were adjusted to be 5.80 and 8.06 at 40° C., respectively.

<Preparation of Comparative Emulsion Em-2>

Comparative Emulsion Em-2 was prepared in the same manner as in Comparative Emulsion Em-1, except that Solutions D-1 and E-1 were replaced by the following Solutions D-2 and E-2, respectively.

(Solution D-2)

An aqueous solution containing 1.35N potassium bromide and 0.15N potassium iodide (Solution E-2)

An aqueous solution containing 3.43N potassium bromide and 0.07N potassium iodide <Preparation of Inventive Emulsion Em-3>

By making use of the following 9 kinds of solutions, Inventive Emulsion Em-3 containing tabular-shaped silver halide grains was prepared.

| | |
|---|---|
| (Solution J) | |
| Ossein gelatin | 14.0 g |
| Distilled water | 5700 ml |
| A 10% solution containing sodium polyisopropylene-polyethyleneoxy-disuccinate | 1.4 ml |
| (Solution K) | |
| An aqueous 1.5N silver nitrate solution | |
| (Solution L) | |
| An aqueous 3.5N silver nitrate solution | |
| (Solution M-1) | |
| An aqueous solution containing 1.38N potassium bromide and 0.12N potassium iodide | |

-continued

| |
|---|
| (Solution N) |
| An aqueous 1.5N potassium bromide solution |
| (Solution P) |
| An aqueous 3.5N potassium bromide solution |
| (Solution Q) |
| A fine-grain emulsion comprising gelatin of 3% by weight and silver iodide grains having an average grain size of 0.05 μm |

Preparation of Solution Q

Two thousand milliliters (2000 ml) each of an aqueous solution containing silver nitrate in an amount of 7.06 mols and an aqueous solution containing potassium iodide were added to 5000 ml of a 6.0 wt % gelatin solution containing 0.06 mols of potassium iodide by taking 10 minutes. In the course of forming fine grains, the pH was controlled to be 2.0 by making use of nitric acid and the temperature was kept at 40° C. After completing the formation of the fine grains, the pH thereof was adjusted to be 6.0 by making use of an aqueous sodium carbonate solution and distilled water was added to make 9500 ml.

(Solution R-1)

This solution was a fine-grain emulsion comprising silver iodobromide grains with an average grain size of 0.04 μm) containing 3 mol % silver iodide, which was prepared in the same manner as in the silver iodide fine-grain emulsion detailed in article (Solution Q); provided that the temperature and pAg thereof were controlled to be 30° C. and 9.8 in the course of forming the fine grains, respectively.

When observing Solution R-1 through a transmission type electron microscope, the ratio of the fine-grains having twinned crystal faces to the whole fine-grains was proved to be 98% in number.

| | |
|---|---|
| (Solution S) | |
| Ossein gelatin | 72.0 g |
| Distilled water | 1300 ml |

Solutions K and M-1 were added each in an amount equivalent to 2% of the whole silver nitrate used therein to Solution J being kept at 35° C. in a reaction chamber in a double-jet precipitation process by taking 3 minutes. In the course of adding them, the pH thereof was controlled to be 2.0 by making use of nitric acid and the pAg thereof was kept at 9.7. Successively, the pH was controlled to be 6.0 by making use of potassium hydroxide and Solution S was then added thereto, so that the mixture was ripened at 60° C. for 10 minutes. Then, Solutions K, Q and N were added in an amount equivalent to 28% of the whole amount of silver nitrate used therein by taking 25 minutes in a double-jet precipitation process while keeping the pAg at 9.0 and the flow rate of Solution K to Solution Q at 5.70. Further, Solutions L, P and Q were added in an amount equivalent to 50% of the whole silver nitrate used therein by taking 50 minutes in a double-jet precipitation process while keeping the pAg at 8.6 and the flow rate of Solution L to Solution Q at 6.86. Thereafter, Solution R-1 was added in an amount equivalent to 20% of the whole amount of silver nitrate used therein by taking 10 minutes and then the resulting mixture was ripened for 20 minutes. At that time, the whole amount of silver nitrate used therein was 1200 g.

Successively, after a desalting treatment was carried out in accordance with the method described in JP O.P.I. Publication No. 5-72658/1993, gelatin was added and then the emulsion blocks were redispersed. The pH and pAg of the dispersed emulsion were adjusted to be 5.80 and 8.06 at 40° C., respectively.

<Preparation of Inventive Emulsion Em-4>

Inventive Emulsion Em-4 was prepared in quite the same manner as in Inventive Emulsion Em-3, except that the flow rate of Solution K to Solution Q was changed into 4.46, the flow rate of Solution L to Solution Q was changed into 10.4, solution R-1 was replaced by the following Solution R-2 and Solution M-1 was replaced by the following Solution M-2.

(Solution R-2)

A fine-grain emulsion having a proportion of fine-grains having twinned crystal faces of 80% in number comprising silver iodobromide grains with an average grain size of 0.04 μm containing 2 mol % of silver iodide, that was prepared in the same manner as in Solution R-1.

(Solution M-2)

An aqueous solution containing 1.35N potassium bromide and 0.15N potassium iodide.

<Preparation of Inventive Emulsion Em-5>

Inventive Emulsion Em-5 was prepared by making use of Solutions J through S which were the same as those used for preparing Inventive Emulsion Em-3.

Solutions K and M-1 were added each in an amount equivalent to 2% of the whole silver nitrate used therein to Solution J being kept at 35° C. in a reaction chamber in a double-jet precipitation process by taking 3 minutes. In the course of adding them, the pH thereof was controlled to be 2.0 by making use of nitric acid and the pAg thereof was kept at 9.5. Successively, the pH was controlled to be 6.0 by making use of potassium hydroxide and Solution S was then added thereto, so that the mixture was ripened at 60° C. for 10 minutes. Then, Solutions K, Q and N were added in an amount equivalent to 28% of the whole amount of silver nitrate used therein by taking 35 minutes in a double-jet precipitation process while keeping the pAg at 8.8 and the flow rate of Solution K to Solution Q at 4.03. Further, Solutions L, P and Q were added in an amount equivalent to 50% of the whole silver nitrate used therein by taking 50 minutes in a double-jet precipitation process while keeping the pAg at 8.6 and the flow rate of Solution L to Solution Q at 18.4. Thereafter, Solution R-1 was added in an amount equivalent to 20% of the whole amount of silver nitrate used therein by taking 10 minutes and then the resulting mixture was ripened for 20 minutes. At that time, the whole amount of silver nitrate used therein was 1200 g.

Successively, after a desalting treatment was carried out in accordance with the method described in JP O.P.I. Publication No. 5-72658/1993, gelatin was added and then the emulsion blocks were redispersed. The pH and pAg of the dispersed emulsion were adjusted to be 5.80 and 8.06 at 40° C., respectively.

<Preparation of Inventive Emulsion Em-6>

Inventive Emulsion Em-6 was prepared by making use of Solutions J through S which were the same as those used for preparing Inventive Emulsion Em-3.

Solutions K and M-1 were added each in an amount equivalent to 2% of the whole silver nitrate used therein to Solution J being kept at 35° C. in a reaction chamber in a double-jet precipitation process by taking 3 minutes. In the course of adding them, the pH thereof was controlled to be 2.0 by making use of nitric acid and the pAg thereof was kept at 9.7. Successively, the pH was controlled to be 6.0 by making use of potassium hydroxide and Solution S was then added thereto, so that the mixture was ripened at 60° C. for 20 minutes. Then, Solutions K, Q and N were added in an amount equivalent to 28% of the whole amount of silver nitrate used therein by taking 35 minutes in a double-jet precipitation process while keeping the pAg at 8.7 and the flow rate of Solution K to Solution Q at 4.03. Further, Solutions L, P and Q were added in an amount equivalent to 50% of the whole silver nitrate used therein by taking 50 minutes in a double-jet precipitation process while keeping the pAg at 8.6 and the flow rate of Solution L to Solution Q at 18.4. Thereafter, Solution R-1 was added in an amount equivalent to 20% of the whole amount of silver nitrate used therein by taking 10 minutes and then the resulting mixture was ripened for 20 minutes. At that time, the whole amount of silver nitrate used therein was 1200 g.

Successively, after a desalting treatment was carried out in accordance with the method described in JP O.P.I. Publication No. 5-72658/1993, gelatin was added and then the emulsion blocks were redispersed. The pH and pAg of the dispersed emulsion were adjusted to be 5.80 and 8.06 at 40° C., respectively.

<Preparation of Comparative Emulsion Em-7>

Comparative Emulsion Em-7 was prepared by making use of solutions J through S which were the same as those used for preparing inventive Emulsion Em-3.

Solutions K and M-1 were added each in an amount equivalent to 2% of the whole silver nitrate used therein to solution J being kept at 35° C. in a reaction chamber in a double-jet precipitation process by taking 3 minutes. In the course of adding them, the pH thereof was controlled to be 2.0 by making use of nitric acid and the pAg thereof was kept at 10.0. Successively, the pH was controlled to be 6.0 by making use of potassium hydroxide and Solution S was then added thereto, so that the mixture was ripened at 60° C. for 10 minutes. Then, Solutions K, Q and N were added in an amount equivalent to 28% of the whole amount of silver nitrate used therein by taking 20 minutes in a double-jet precipitation process while the flow rate of Solution K to Solution Q was being kept at 4.03. Further, Solutions L, P and Q were added in an amount equivalent to 20% of the whole silver nitrate used therein by taking 46 minutes in a double-jet precipitation process while keeping the pAg at 8.8 and the flow rate of Solution L to Solution Q at 18.4. Thereafter, Solution R-1 was added in an amount equivalent to 20% of the whole amount of silver nitrate used therein by taking 10 minutes and then the resulting mixture was ripened for 20 minutes. At that time, the whole amount of silver nitrate used therein was 1200 g.

Successively, after a desalting treatment was carried out in accordance with the method described in JP O.P.I. Publication No. 5-72658/1993, gelatin was added and then the emulsion blocks were redispersed. The pH and pAg of the dispersed emulsion were adjusted to be 5.80 and 8.06 at 40° C., respectively.

<Preparation of Inventive Emulsion Em-8>

Inventive Emulsion Em-8 was prepared in quite the same manner as in Inventive Emulsion Em-3, except that Solution R-1 was replaced by the following Solution R-3.

(Solution R-3)

This solution was prepared in the same manner as in solution R-I, except that the pAg was kept to be 7.8 in the course of forming the fine grains, and that the proportion of the fine grains having twinned crystal faces was 4% in number.

<Preparation of Comparative Emulsion Em-9>

Comparative Emulsion Em-9 was prepared by making use of Solutions J through S which were the same as those used for preparing Inventive Emulsion Em-3.

Solutions K and M-1 were added each in an amount equivalent to 2% of the whole silver nitrate used therein to solution J being kept at 35° C. in a reaction chamber in a double-jet precipitation process by taking 3 minutes. In the course of adding them, the pH thereof was controlled to be 2.0 by making use of nitric acid and the pAg thereof was kept at 9.4. Successively, the pH was controlled to be 6.0 by making use of potassium hydroxide and Solution S was then added thereto, so that the mixture was ripened at 60° C. for 10 minutes. Then, Solutions K, Q and N were added in an amount equivalent to 28% of the whole amount of silver nitrate used therein by taking 30 minutes in a double-jet precipitation process while keeping the pAg at 9.4 and the flow rate of solution K to Solution Q at 4.03. Further, Solutions L, P and Q were added in an amount equivalent to 50% of the whole silver nitrate used therein by taking 40 minutes in a double-jet precipitation process while keeping the pAg at 8.8 and the flow rate of Solution L to Solution Q at 18.4. Thereafter, solution R-1 was added in an amount equivalent to 20% of the whole amount of silver nitrate used therein by taking 10 minutes and then the resulting mixture was ripened for 20 minutes. At that time, the whole amount of silver nitrate used therein was 1200 g.

Successively, after a desalting treatment was carried out in accordance with the method described in JP O.P.I. Publication No. 5-72658/1993, gelatin was added and then the emulsion blocks were redispersed. The pH and pAg of the dispersed emulsion were adjusted to be 5.80 and 8.06 at 40° C., respectively.

<Preparation of Comparative Emulsion Em-10>

Comparative Emulsion Em-10 was prepared by making use of Solutions J through S which were the same as those used for preparing Inventive Emulsion Em-3.

Solutions K and M-1 were added each in an amount equivalent to 2% of the whole silver nitrate used therein to solution J being kept at 35° C. in a reaction chamber in a double-jet precipitation process by taking 3 minutes. In the course of adding them, the pH thereof was controlled to be 2.0 by making use of nitric acid and the pAg thereof was kept at 9.4. Successively, the pH was controlled to be 6.0 by making use of potassium hydroxide and Solution S was then added thereto, so that the mixture was ripened at 65° C. for 20 minutes. Then, Solutions K, Q and N were added in an amount equivalent to 28% of the whole amount of silver nitrate used therein by taking 25 minutes in a double-jet precipitation process while keeping the pAg at 9.0 and the flow rate of Solution K to Solution Q at 4.03. Further, Solutions L, P and Q were added in an amount equivalent to 50% of the whole silver nitrate used therein by taking 48 minutes in a double-jet precipitation process while keeping the pAg at 8.6 and the flow rate of Solution L to Solution Q at 18.4. Thereafter, Solution R-1 was added in an amount equivalent to 20% of the whole amount of silver nitrate used therein by taking 10 minutes and then the resulting mixture was ripened for 20 minutes. At that time, the whole amount of silver nitrate used therein was 1200 g.

Successively, after a desalting treatment was carried out in accordance with the method described in JP O.P.I. Publication No. 5-72658/1993, gelatin was added and then the emulsion blocks were redispersed. The pH and pAg of the dispersed emulsion were adjusted to be 5.80 and 8.06 at 40° C., respectively.

(Preparation of Twinned Crystal Seed Emulsion TEm-1)

A seed emulsion having two parallel twinned crystal faces was prepared in the following procedures.

| | |
|---|---|
| (X-1) | |
| Ossein gelatin | 80.0 g |
| Potassium bromide | 47.4 g |
| A 10% methanol solution containing sodium polyisopropylene-polyethyleneoxy-disuccinate | 0.48 ml |
| Add water to make | 8000.0 ml |
| (X-2) | |
| Silver nitrate | 1200.0 g |
| Add water to make | 1600.0 ml |
| (X-3) | |
| Ossein gelatin | 32.2 g |
| Potassium bromide | 790.0 g |
| Potassium iodide | 70.34 g |
| Add water to make | 1600.0 ml |
| (X-4) | |
| Aqueous ammonia | 470.0 ml |

Solutions X-2 and X-3 were each added, in a double-jet process, to Solution X-1 violently stirred at 40° C., so that a nucleation was carried out. The pBr thereof was kept at 1.60 throughout the course.

Thereafter, the temperature was lowered to 20° C. by taking 30 minutes and, Solution X-4 was added by taking one minute. Successively, a ripening treatment was carried out for 5 minutes. At the time of carrying out the ripening treatment, the KBr concentration was 0.03 mols/liter and the ammonia concentration was 0.66 mols/liter.

After completing the ripening treatment, the pH was adjusted to be 6.0 and a desalting treatment was carried out in an ordinary procedures. When the resulting seed emulsion grains were observed through an electron microscope, the grains were proved to be hexagonal tabular-shaped grains having two twinned crystal faces parallel to each other.

The seed emulsion grains had an average grain size of 0.217 μm and a proportion of the two parallel twinned crystal faces of 75% in number.

<Preparation of Comparative Emulsion Em-11>

By making use of the following 7 kinds of solutions, Comparative Emulsion Em-11 was prepared.

| | |
|---|---|
| (Solution Y-1) | |
| Ossein gelatin | 253.7 g |
| Distilled water | 3500 ml |
| A 10% methanol solution containing polyisopropylene-polyethyleneoxy-disuccinate | 1.5 ml |
| Seed emulsion (TEM-1) | 1.764 mols |

-continued

| | |
|---|---|
| An aqueous 28 wt % ammonia solution | 528.0 ml |
| An aqueous 56 wt % acetic acid solution | 795.0 ml |
| Add distilled water to make | 5930.0 ml |
| (Solution Y-2) | |
| An aqueous 3.5N ammoniacal silver nitrate solution, provided, the pH was adjusted to be 9.0 with the use of ammonium nitrate. | |
| (Solution Y-3) | |
| An aqueous 3.5N potassium bromide solution | |
| (Solution Y-4) | |
| A fine-grain emulsion comprising 3 wt % of gelatin and silver iodide grains having an average grain size of 0.05 μm | 1.40 mols |

Preparation of Solution Y-4

Two thousand milliliters each of 7.06 mols of silver nitrate and an aqueous solution containing 7.06 mols of potassium iodide were added to 5000 ml of a 6.0 wt % gelatin solution containing 0.06 mols of potassium iodide, by taking 10 minutes. In the course of forming the fine-grains, the pH was controlled to be 2.0 by making use of nitric acid and the temperature was controlled to be 40° C. After completing the grain formation, the pH was adjusted to be 6.0 by making use of an aqueous sodium carbonate solution.

| | |
|---|---|
| (Solution Y-5) | |
| This emulsion was a fine-grain emulsion comprising silver iodobromide grains containing 2 mol % of silver iodide having an average grain size of 0.04 μm, which was prepared in the same manner as in the silver iodide fine-grain emulsion described in Solution Y-4; provided that the temperature and pAg in the course of forming the fine grains were controlled to be 30° C. and 9.8, respectively and that the proportion of the fine grains having twinned crystal faces was 80% in number. | 3.68 mols |
| (Solution Y-6) | |
| An aqueous 1.75N potassium bromide solution | An amount required |
| (Solution Y-7) | |
| An aqueous 56 wt % acetic acid solution | An amount required |

Solutions Y-2, Y-3 and Y-4 were each added, in a double-jet process, to Solution Y-1 being kept at 70° C. in a reaction chamber by taking 48 minutes. Successively, Solution Y-5 was added independently and constantly by taking 7 minutes and the seed crystals were grown up to be 0.56 μm.

The adding rates of Solutions Y-2 and Y-3 were functionally varied to time so as to meet the critical growth rates, so that the solutions were added at a suitable adding rate so as not to produce any other small grains than the growing seed crystals and nor to be polydispersed by an Ostwald's ripening reaction. Solution Y-4, that was a silver iodide fine-grained emulsion, was supplied by varying the flow rate, or the mol ratio, thereof to that of Solution Y-2, that was an aqueous ammoniacal silver nitrate solution, by varying the to the grain sizes (that means the adding time) so that the variations thereof may correspond to the grain sizes or the adding time, as shown in Table-4. Thereby, a core/shell type silver halide emulsion having a multilayered structure could be prepared.

By making use of Solutions Y-6 and Y-7, the pAg and pH were each controlled in the course of growing the crystals, as shown in Table-4.

The pAg and pH were each measured by making use of a silver sulfide electrode and a glass electrode in an ordinary method.

After completing the growth of the grains, a desalting treatment was carried out in accordance with the procedures described in JP O.P.I. Publication No. 5-72658/1993. Thereafter, gelatin was added and redispersed. The pH and pAg thereof were adjusted to be 5.80 and 8.06 at 40° C., respectively.

When observing the silver halide grains contained in the resulting silver halide emulsion through an scanning type electron microscope, the emulsion was proved to be an octahedral, twinned crystal, monodisperse type emulsion having an average grain size of 0.56 μm and a grain-size distribution range of 12.0%.

TABLE 4

| | Adding time (min.) | Average grain size (μm) | Flow rate of Solution Y-4 | pH | pAg |
|---|---|---|---|---|---|
| Interlayer | 0.0 | 0.217 | 10.3 | 7.0 | 7.8 |
| | 7.33 | 0.264 | 10.3 | 7.0 | 7.8 |
| | 12.34 | 0.293 | 10.3 | 7.0 | 7.8 |
| Core | 15.88 | 0.310 | 30.0 | 7.0 | 7.8 |
| | 22.25 | 0.341 | 30.0 | 7.0 | 7.8 |
| | 29.36 | 0.374 | 30.0 | 6.5 | 9.4 |
| Shell | 34.57 | 0.401 | 10.3 | 6.5 | 9.4 |
| | 37.75 | 0.417 | 10.3 | 6.5 | 9.4 |
| | 40.68 | 0.438 | 7.7 | 6.5 | 9.4 |
| | 44.96 | 0.486 | 0.0 | 6.5 | 9.7 |
| | 47.43 | 0.518 | 0.0 | 6.5 | 9.7 |

TABLE 5

| Emulsion Name | Invention or Comparison | Proportion of tabular grains occupied in the whole grain projected area (%) | Ave. grain-size of tabular grains (μm) | Ave. aspect ratio of tabular grains | AgI content of core/shell (mol %) | Grain size distribution range (%) | Proportion of tabular grains w/2 twinned crystal faces parallel to the principal plane to the whole tabular grain (% in number) |
|---|---|---|---|---|---|---|---|
| Em-1 | Comparison | 90 | 0.59 | 3.8 | 8/3 | 18 | 74 |
| Em-2 | Comparison | 84 | 0.54 | 3.3 | 10/2 | 17 | 70 |
| Em-3 | Invention | 91 | 0.57 | 3.6 | 8/3 | 18 | 74 |
| Em-4 | Invention | 82 | 0.50 | 3.1 | 10/2 | 15 | 70 |
| Em-5 | Invention | 88 | 0.51 | 3.0 | 8/3 | 17 | 74 |
| Em-6 | Invention | 91 | 0.55 | 3.2 | 8/3 | 18 | 74 |
| Em-7 | Comparison | 93 | 0.72 | 5.2 | 8/3 | 21 | 71 |
| Em-8 | Invention | 91 | 0.57 | 3.6 | 8/3 | 18 | 74 |
| Em-9 | Comparison | 89 | 0.59 | 6.7 | 8/3 | 23 | 70 |
| Em-10 | Comparison | 83 | 0.76 | 3.0 | 8/3 | 19 | 74 |
| Em-11 | Comparison | 0 | — | — | — | — | — |

The light-sensitive materials were prepared by coating silver halide emulsions Em-1 through Em-11 on a subbed transparent triacetate cellulose film supports in the following manner, respectively.

The magenta coupler M-1 of 5 g, colored magenta coupler CM-1 of 0.95 g and DIR coupler D-1 of 0.10 g each given below were dissolved in 5 cc of dibutyl phthalate and the resulting solution was mixed with 8 cc of an aqueous 1.0% Alkanol B (alklnaphthalene sulfonate, manufactured by DuPont) and 70 cc of an aqueous 5% gelatin solution. The resulting mixture was then emulsified by making use of a colloid mill.

M-1

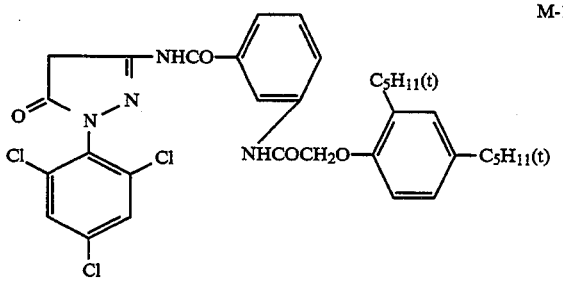

CM-1

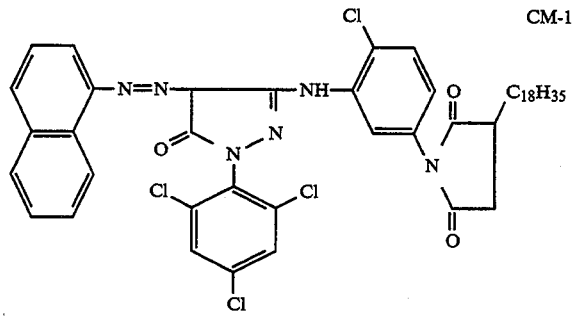

D-1

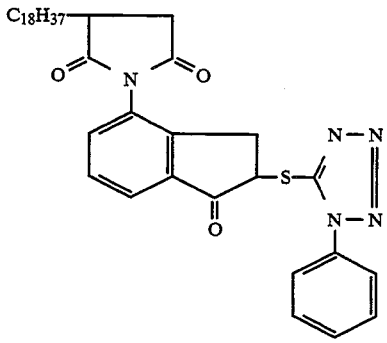

The resulting dispersion and Em-1 through Em-11 were mixed up with 350 g of an emulsion containing 40 g of silver subjected to a sulfur sensitization, a gold sensitization and a color sensitization to green each to be optimum. The resulting mixture was so coated on a triacetate film base as to have an amount of silver coated could be 16 mg/dm$^2$.

Next, a protective layer containing gelatin in an amount of 2.3 g (per sq. meter) thereon, so that Samples No. 11 through No. 21 were prepared.

The samples immediately after prepared and the samples after stored under the following conditions A and B were each exposed to white light for sensitometry and were then processes in the following processing steps.

(Conditions)

A: For 4 days at 65° C. and 30% RH, and

-continued

| | |
|---|---|
| B: For 4 days at 50° C. and 80% RH | |
| Processing steps (at 38° C.) | |
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The compositions of the processing solutions used in each of the processing steps were as follows.

| | |
|---|---|
| <Color developing solution> | |
| 4-amino-3-methyl-N-ethyl-N-(β-hydroxyethyl) aniline sulfate | 4.75 g |
| Sodium sulfite, anhydrous | 4.25 g |
| Hydroxylamine 1/2 sulfate | 2.0 g |
| Potassium carbonate, anhydrous | 37.5 g |
| Sodium bromide | 1.3 g |
| Trisodium nitrilotriacetate (monohydrate) | 2.5 g |
| Potassium hydroxide | 1.0 g |
| Add water to make | 1 liter |
| Adjust PH to be | pH 10.0 |
| <Bleaching solution> | |
| Iron (III) ammonium ethylenediamine-tetraacetate | 100.0 g |
| Diammonium ethylenediaminetetraacetate | 10.0 g |
| Ammonium bromide | 150.0 g |
| Glacial acetic acid | 10.0 g |
| Add water to make | 1 liter |
| Adjust pH with aqueous ammonia to be | pH 6.0 |
| <Fixing solution> | |
| Ammonium thiosulfate | 175.0 g |
| Sodium sulfite, anhydrous | 8.5 g |
| Sodium metasulfite | 2.3 g |
| Add water to make | 1 liter |
| Adjust pH with acetic acid to be | pH 6.0 |
| <Stabilizing solution> | |
| Formalin | 1.5 cc |
| Konidux (manufactured by Konica Corp.) | 7.5 cc |
| Add water to make | 1 liter |

By making use of each of the processed samples, the variation ratios of the sensitivity, RMS granularity and sharpness (MTF) were evaluated among the case of exposing them to light and processed immediately after preparing them and the cases of storing them under the conditions A and B.

The sensitivities thereof were represented by the reciprocals of a light-received amount for giving a density of a fog density +0.15. The sensitivity variation ratios (%) were obtained in the following formula. The results obtained each from the samples processed under the conditions A and B were evaluated. The sensitivity variation ratio of each sample were set to be a value relative to the sensitivity variation ratio obtained from Sample No. 11 that was regarded as a control value of 100.

Sensitivity variation ratio =

$$\left| \frac{\left(\begin{array}{c}\text{Sensitivity obtained}\\ \text{when a subject sample}\\ \text{was processed after}\\ \text{storing it under the}\\ \text{conditions } A \text{ or } B\end{array}\right) - \left(\begin{array}{c}\text{Sensitivity obtained}\\ \text{when the subject}\\ \text{sample was processed}\\ \text{immediately after}\\ \text{preparing it}\end{array}\right)}{\left(\begin{array}{c}\text{Sensitivity obtained when the subject sample was}\\ \text{processed immediately after preparing it}\end{array}\right)} \right| \times$$

-continued 100 (%)

The RMS granularity was represented by a value 1000 times as many as the density variation value obtained when scanning a density of the minimum density +0.5 through a microdensitometer having a scanning aperture area of 250 $\mu m^2$. The granularity variation ranges (%) of the samples were obtained from the following formula. The results obtained each from the samples processed under the conditions A and B were evaluated. The granularity variation ratios of each sample were set to be a value relative to the granularity variation ratio obtained from Sample No. 11 that was regarded as a control value of 100.

$$RMS\text{ granularity variation ratio} = \left| \frac{\left(\begin{array}{c}RMS\text{ granularity}\\ \text{(obtained when a subject sample}\\ \text{was processed after storing}\\ \text{it under the conditions } A \text{ or } B)\end{array}\right) - \left(\begin{array}{c}RMS\text{ granularity}\\ \text{(obtained when the subject sample}\\ \text{was processed immediately}\\ \text{after preparing it)}\end{array}\right)}{\left(\begin{array}{c}RMS\text{ granularity}\\ \text{(obtained when the subject sample was processed}\\ \text{immediately after preparing it)}\end{array}\right)} \right| \times 100\ (\%)$$

The sharpness was obtained in the following manner. A density measurement was made on a subject sample exposed to light on a square-wave chart through a slit having an area of 300 $\mu m$ height by 2 $\mu m$ width by making use of a microdensitometer, Model PDM-5 Type AR (manufactured by Konica Corp.) and the resolving power to the input was obtained in terms of percentages, so that an MTF (standing for modulation transfer function) was obtained when the spatial frequency was 30 lines/mm.

The above-mentioned MTF variation ratios (%) were obtained from the following Formula. The results obtained each from the samples processed under the conditions A and B were evaluated. The MTF variation ratios of each sample were set to be a value relative to the MTF value variation obtained from Sample No. 11 that was regarded as a control value of 100.

$$MTF\text{ variation ratio} = \left| \frac{\left(\begin{array}{c}MTF\text{ value obtained when a subject sample}\\ \text{was processed after storing it under}\\ \text{the conditions } A \text{ or } B\end{array}\right) - \left(\begin{array}{c}MTF\text{ value obtained when the subject}\\ \text{sample was processed immediately}\\ \text{after preparing it}\end{array}\right)}{\left(\begin{array}{c}MTF\text{ value obtained when the subject sample was}\\ \text{processed immediately after preparing it}\end{array}\right)} \right| \times 100\ (\%)$$

Table-6 shows the results of the evaluation made on the sensitivity variation ranges, RMS granularity variation ranges and MTF variation ranges of coated samples No. 11 through No. 21 each applied with silver halide emulsions Em-1 through Em-11.

TABLE 6

| | | | Conditions A | | | Conditions B | | |
|---|---|---|---|---|---|---|---|---|
| Sample No. | Emulsion No. | Invention or Comparison | Relative sensitivity variation ratio | Relative RMS granularity variation ratio | Relative MTF variation ratio | Relative sensitivity variation ratio | Relative RMS granularity variation ratio | Relative MTF variation ratio |
| 11 | Em-1 | Comparison | 100 | 100 | 100 | 100 | 100 | 100 |
| 12 | Em-2 | Comparison | 103 | 102 | 104 | 101 | 100 | 103 |
| 13 | Em-3 | Invention | 81 | 86 | 80 | 83 | 82 | 79 |
| 14 | Em-4 | Invention | 87 | 89 | 90 | 87 | 88 | 90 |
| 15 | Em-5 | Invention | 80 | 81 | 82 | 82 | 81 | 81 |
| 16 | Em-6 | Invention | 83 | 83 | 84 | 83 | 84 | 84 |
| 17 | Em-7 | Comparison | 103 | 98 | 96 | 99 | 99 | 98 |
| 18 | Em-8 | Invention | 89 | 92 | 88 | 87 | 90 | 89 |
| 19 | Em-9 | Comparison | 96 | 95 | 97 | 98 | 98 | 96 |
| 20 | Em-10 | Comparison | 92 | 96 | 101 | 94 | 96 | 99 |
| 21 | Em-11 | Comparison | 92 | 93 | 96 | 91 | 94 | 94 |

From the contents of Table-6, it was proved that Samples No. 13 through No. 16 and No. 18, which were applied with silver halide emulsions Em-3 through Em-6 and Em-8 of the invention, could display the more excellent characteristics stability in the sensitivity variation, RMS granularity variation and MTF variation, as compared to the samples applied with the comparative emulsions.

EXAMPLE 2

Silver halide emulsions Em-1 through Em-11 each used in Example 1 were subjected to the optimum chemical sensitization. The resulting emulsions were used and denoted by Emulsion-A in the following formulas of the samples.

Multilayered color light-sensitive materials No. 21 through No. 31 were each prepared by forming each of the layers having the following compositions on a triacetyl cellulose film support, in order from the support side.

In the following descriptions, an amount of a material added to a light-sensitive material will be indicated by a gram per sq.meter unless otherwise expressly stated. The amounts of silver halide and colloidal silver used therein will be indicated by converting into the silver contents thereof. An amount of the sensitizing dyes used therein will be indicated by a mol number per mol of a silver halide content.

| | |
|---|---|
| Layer 1: An antihalation layer | |
| Black colloidal silver | 0.16 |
| UV absorbent (UV-1) | 0.30 |
| Gelatin | 1.70 |
| Layer 2: Interlayer (IL-1) | |
| Gelatin | 0.80 |
| Layer 3: Low-speed red-sensitive layer (RL) | |
| A silver iodobromide emulsion (having an average grain size of 0.30 μm) | 0.40 |
| Sensitizing dye (S-1) | $1.2 \times 10^{-4}$ |
| Sensitizing dye (S-2) | $0.2 \times 10^{-4}$ |
| Sensitizing dye (S-3) | $2.0 \times 10^{-4}$ |
| Sensitizing dye (S-4) | $1.2 \times 10^{-4}$ |
| Cyan coupler (C-1) | 0.33 |
| Colored cyan coupler (CC-1) | 0.05 |
| High boiling solvent (Oil-1) | 0.30 |
| Gelatin | 0.55 |
| Layer 4: Medium-speed red-sensitive layer (RM) | |
| A silver iodobromide emulsion (having an average grain size of 0.4 μm) | 0.48 |
| Sensitizing dye (S-1) | $1.5 \times 10^{-4}$ |
| Sensitizing dye (S-2) | $0.2 \times 10^{-4}$ |
| Sensitizing dye (S-3) | $2.5 \times 10^{-4}$ |
| Sensitizing dye (S-4) | $1.5 \times 10^{-4}$ |
| Cyan coupler (C-1) | 0.30 |
| Colored cyan coupler (CC-1) | 0.05 |
| High boiling solvent (Oil-1) | 0.40 |
| Gelatin | 0.60 |
| Layer 5: High-speed red-sensitive layer (RH) | |
| A silver iodobromide emulsion (Emulsion-A) | 0.66 |
| Sensitizing dye (S-1) | $1.0 \times 10^{-4}$ |
| Sensitizing dye (S-2) | $0.2 \times 10^{-4}$ |
| Sensitizing dye (S-3) | $1.7 \times 10^{-4}$ |
| Sensitizing dye (S-4) | $1.0 \times 10^{-4}$ |
| Cyan coupler (C-2) | 0.10 |
| Colored cyan coupler (CC-1) | 0.01 |
| DIR compound (D-1) | 0.02 |
| High boiling solvent (oil-1) | 0.15 |
| Gelatin | 0.53 |
| Layer 6: Interlayer (IL-2) | |
| Gelatin | 0.80 |
| Layer 7: Low-speed green-sensitive layer (GL) | |
| A silver iodobromide emulsion (having an average grain size of 0.40 μm) | 0.60 |
| A silver iodobromide emulsion (having an average grain size of 0.30 μm) | 0.40 |
| Sensitizing dye (S-1) | $0.6 \times 10^{-4}$ |
| Sensitizing dye (S-5) | $5.1 \times 10^{-4}$ |
| Magenta coupler (M-1) | 0.55 |
| Colored magenta coupler (CM-1) | 0.17 |
| DIR compound (D-1) | 0.03 |
| High boiling solvent (Oil-2) | 0.70 |
| Gelatin | 1.56 |
| Layer 8: High-speed green-sensitive layer (GH) | |
| A silver iodobromide emulsion (Emulsion-A) | 0.60 |
| Sensitizing dye (S-6) | $1.5 \times 10^{-4}$ |
| Sensitizing dye (S-7) | $1.5 \times 10^{-4}$ |
| Sensitizing dye (S-8) | $1.5 \times 10^{-4}$ |

-continued

| | |
|---|---|
| Magenta coupler (M-1) | 0.06 |
| Magenta coupler (M-2) | 0.02 |
| Colored magenta coupler (CM-2) | 0.02 |
| DIR compound (D-3) | 0.002 |
| High boiling solvent (Oil-2) | 0.15 |
| Gelatin | 0.45 |
| Layer 9: Yellow filter layer (YC) | |
| Yellow colloidal silver | 0.12 |
| HS-1 | 0.20 |
| HS-2 | 0.14 |
| High boiling solvent (Oil-2) | 0.18 |
| Gelatin | 0.80 |
| Layer 10: Low-speed blue-sensitive layer (BL) | |
| A silver iodobromide emulsion (having an average grain size of 0.4 μm) | 0.18 |
| A silver iodobromide emulsion (having an average grain size of 0.3 μm) | 0.35 |
| Sensitizing dye (S-9) | $5.1 \times 10^{-4}$ |
| Sensitizing dye (S-10) | $2.0 \times 10^{-4}$ |
| Yellow coupler (Y-1) | 0.58 |
| Yellow coupler (Y-2) | 0.30 |
| High boiling solvent (Oil-2) | 0.15 |
| Gelatin | 1.20 |
| Layer 11: High-speed blue-sensitive layer (BH) | |
| Silver iodobromide emulsion (Emulsion-A) | 0.45 |
| Sensitizing dye (S-9) | $2.8 \times 10^{-4}$ |
| Sensitizing dye (S-10) | $1.0 \times 10^{-4}$ |
| Yellow coupler (Y-1) | 0.10 |
| High boiling solvent (Oil-2) | 0.04 |
| Gelatin | 0.50 |
| Layer 12: Protective layer 1 (Pro-1) | |
| Silver iodobromide (having an average grain size of 0.07 μm) | 0.30 |
| UV absorbent (UV-1) | 0.07 |
| UV absorbent (UV-2) | 0.10 |
| High boiling solvent (Oil-2) | 0.07 |
| High boiling solvent (Oil-3) | 0.07 |
| HS-1 | 0.25 |
| Gelatin | 0.80 |
| Layer 13: Protective layer 2 (Pro-2) | |
| An alkali-soluble matting agent (having an average particle size of 2 μm) | 0.13 |
| Polymethyl methacrylate (having an average particle size of 3 μm) | 0.02 |
| Gelatin | 0.50 |

Besides the above-given compositions, coating aid SU-1, dispersion aid SU-2, layer hardeners H-1 and H-2 and anti-irradiation dyes AI-1 and AI-2 were each suitably added.

The structures of the compounds used for preparing the above-mentioned Sample-1 will be shown below.

Oil-1: Dioctyl phthalate,
Oil-2: Tricresyl phosphate,
Oil-3: Dibutyl phthalate,
SU-1: Sodium dioctyl sulfosuccinate,
SU-2: Sodium tri-i-propylnaphthalene sulfonate,
H-1: Sodium 2,4-dichloro-6-hydroxy-s-triazine,
HS-2: 2-sec-octadecyl-5-methyl hydroquinone,

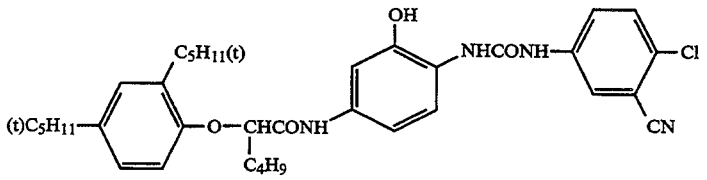

C-1

-continued
C-2
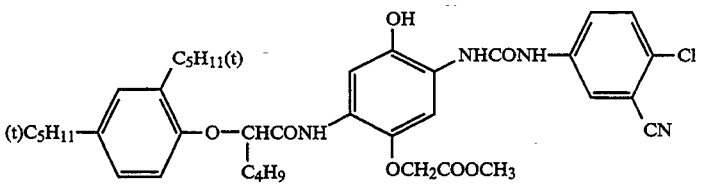
M-1
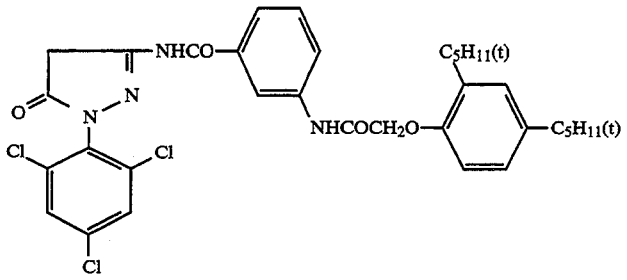
M-2
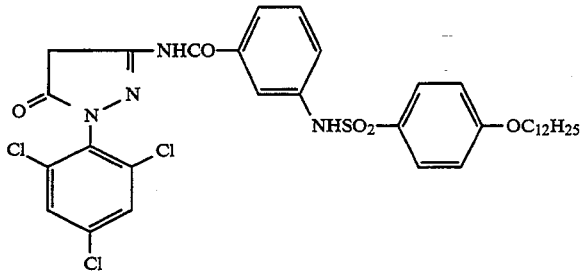
Y-1
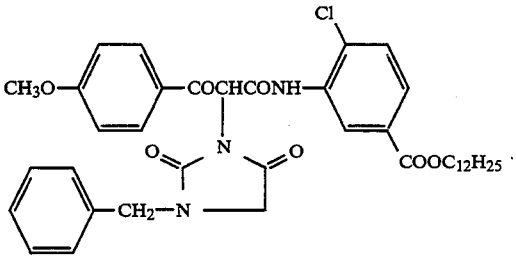
Y-2
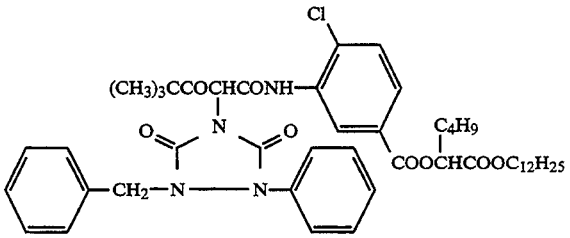
CC-1
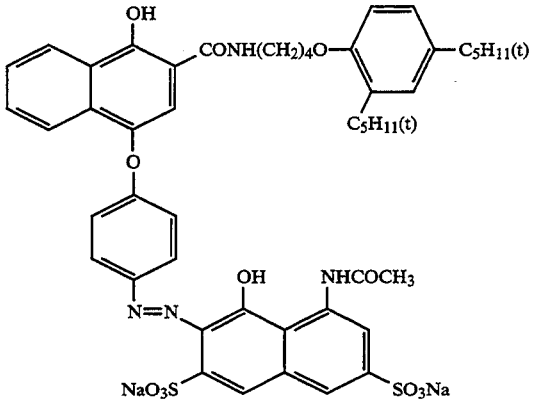

-continued
CM-1
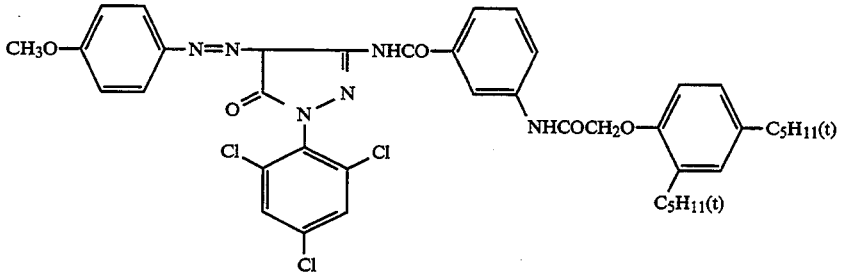
CM-2
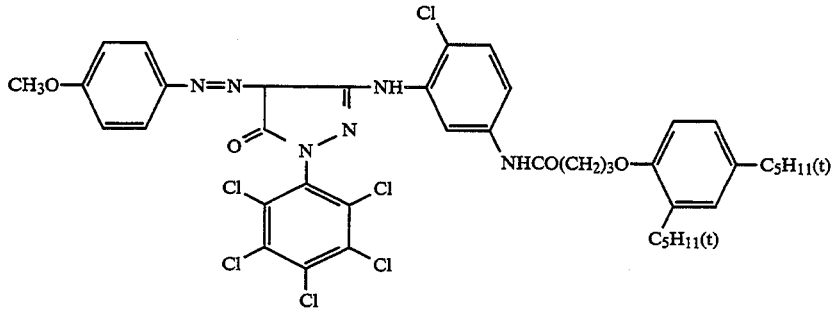
D-1
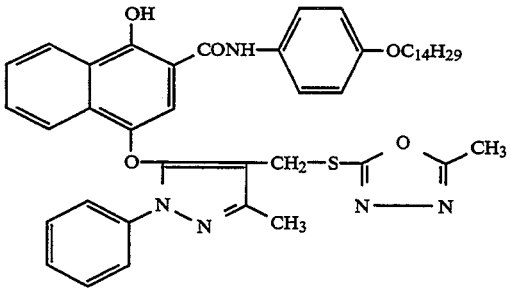
D-2
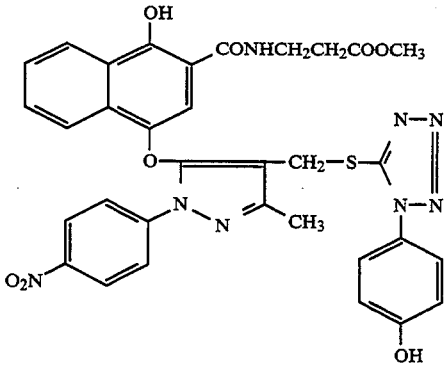
D-3
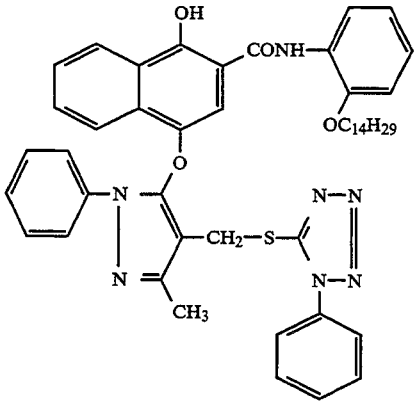
HS-1
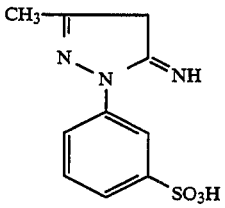
UV-1
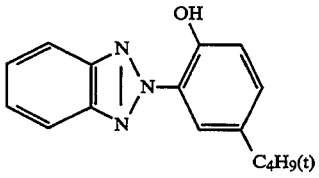
UV-2
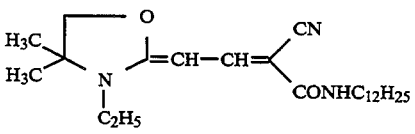

-continued
S-1
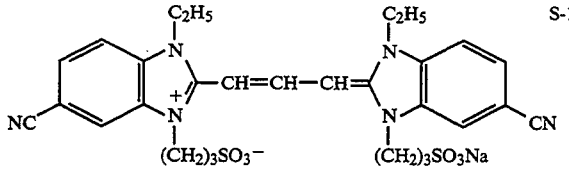
S-2
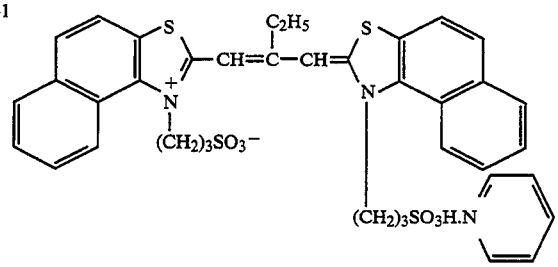
S-3
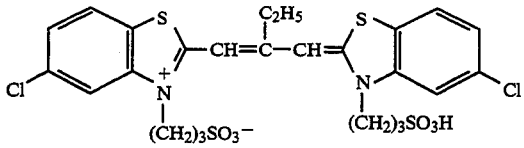
S-4
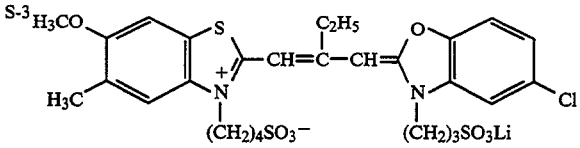
S-5
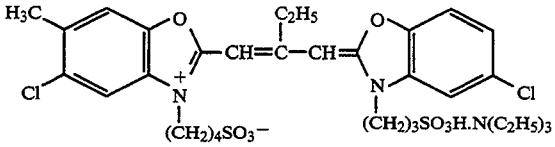
S-6
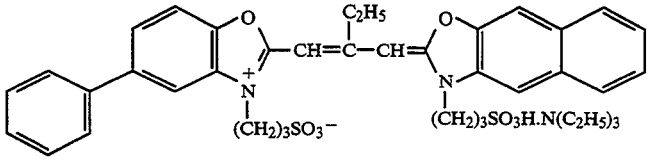
S-7
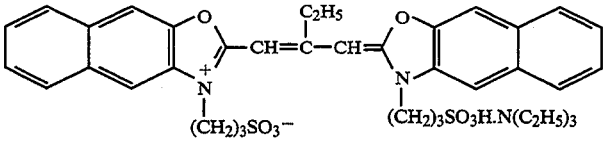
S-8
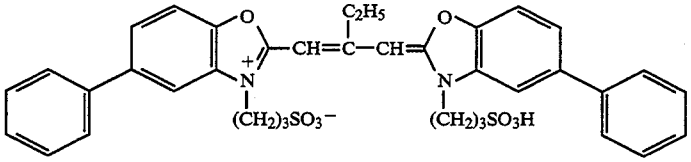
S-9
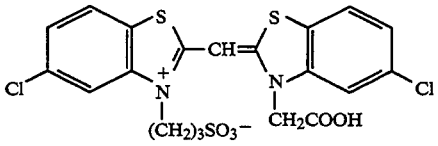
S-10
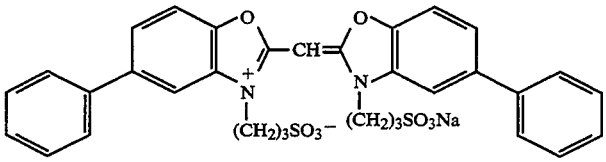

-continued

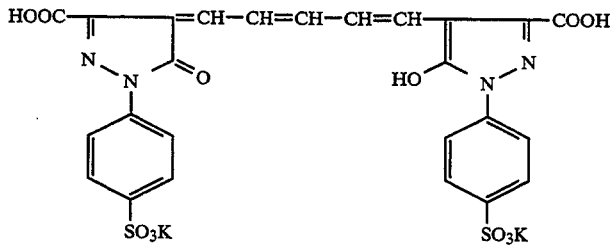

AI-1

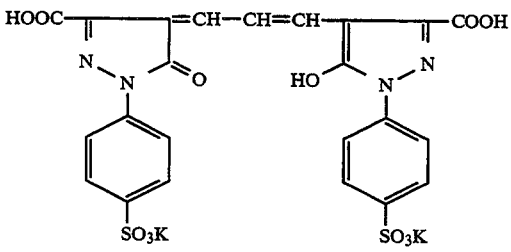

AI-2

$(CH_2{=}CHSO_2CH_2)_2O$ H-2

The resulting samples were each exposed to light in the same manner as in Example 1 and developed in the following processing steps.

| Processing steps | | |
|---|---|---|
| Color developing | 3 min. 15 sec. | 38.0 ± 0.1° C. |
| Bleaching | 6 min. 30 sec. | 38.0 ± 3.0° C. |
| Washing | 3 min. 15 sec. | 24–41° C. |
| Fixing | 6 min. 30 sec. | 38.0 ± 3.0° C. |
| Washing | 3 min. 15 sec. | 24–41° C. |
| Stabilizing | 1 min. 30 sec. | 38.0 ± 3.0° C. |
| Drying | | Not higher than 50° C. |

The compositions of the processing solutions used in the processing steps were as follows.

| | |
|---|---|
| <Color developing solution> | |
| 4-amino-3-methyl-N-ethyl-N-(β-hydroxyl) aniline sulfate | 4.75 g |
| Sodium sulfite, anhydrous | 4.25 g |
| Hydroxylamine 1/2 sulfate | 2.0 g |
| Potassium carbonate, anhydrous | 37.5 g |
| Sodium bromide | 1.3 g |
| Trisodium nitrilotriacetate (monohydrate) | 2.5 g |
| Potassium hydroxide | 1.0 g |
| Add water to make | 1 liter |
| Adjust pH to be | pH = 10.1 |
| <Bleaching solution> | |
| Iron (III) ammonium ethylenediamine tetraacetate | 100.0 g |

-continued

| | |
|---|---|
| Diammonium ethylenediamine tetraacetate | 10.0 g |
| Ammonium bromide | 150.0 g |
| Glacial acetic acid | 10.0 g |
| Add water to make | 1 liter |
| Adjust pH with aqueous ammonia to be | pH = 6.0 |
| <Fixing solution> | |
| Ammonium thiosulfate | 175.0 g |
| Sodium sulfite, anhydrous | 8.5 g |
| Sodium metasulfite | 2.3 g |
| Add water to make | 1 liter |
| Adjust pH with acetic acid to be | pH = 6.0 |
| <Stabilizing solution> | |
| Formalin | 1.5 cc |
| Konidux (manufactured by Konica Corp.) | 7.5 cc |
| Add water to make | 1 liter |

With the samples No. 21 through No. 31, the sensitivity variation ratios, RMS granularity variation ratios and MTF variation ratios thereof were evaluated in the same manners as in Example 1. The results thereof will be shown in Table-7.

TABLE 7

| | | | Conditions A | | | Conditions B | | |
|---|---|---|---|---|---|---|---|---|
| Sample No. | Emulsion No. | Invention or Comparison | Relative sensitivity variation ratio | Relative RMS granularity variation ratio | Relative MTF variation ratio | Relative sensitivity variation ratio | Relative RMS granularity variation ratio | Relative MTF variation ratio |
| 21 | Em-1 | Comparison | 100 | 100 | 100 | 100 | 100 | 100 |
| 22 | Em-2 | Comparison | 105 | 102 | 106 | 103 | 102 | 100 |
| 23 | Em-3 | Invention | 82 | 86 | 82 | 82 | 84 | 85 |
| 24 | Em-4 | Invention | 89 | 88 | 86 | 90 | 89 | 88 |
| 25 | Em-5 | Invention | 82 | 81 | 85 | 80 | 82 | 81 |
| 26 | Em-6 | Invention | 82 | 80 | 83 | 81 | 84 | 85 |
| 27 | Em-7 | Comparison | 101 | 100 | 98 | 97 | 96 | 99 |
| 28 | Em-8 | Invention | 93 | 92 | 90 | 91 | 92 | 88 |
| 29 | Em-9 | Comparison | 104 | 102 | 98 | 106 | 101 | 97 |
| 30 | Em-10 | Comparison | 97 | 99 | 96 | 98 | 97 | 99 |
| 31 | Em-11 | Comparison | 94 | 97 | 96 | 99 | 97 | 98 |

From table-7, it was proved that Samples No. 23 through No. 26 and No. 18, which were applied with silver halide emulsions Em-3 through Em-6 and Em-8 of the invention, could display the more excellent stability in the characteristics including sensitivity variation, RMS granularity variation and MTF variation, as compared to the samples applied with the comparative emulsions.

When making use of a silver halide emulsion prepared of twinned crystal, fine-grained silver halide grains in the invention, it was proved that further more excellent characteristics could be displayed.

What is claimed is:

1. A silver halide photographic emulsion comprising silver halide grains formed under a condition that fine grains of silver halide substantially comprising twinned crystals are supplied into a protective colloid solution, in which said silver halide grains are formed, during a course of formation of said grains, and a sum of a projection area of tabular grains each having an aspect ratio larger than 1.2 accounts for not less than 50% of a total projection area of all silver halide grains of said emulsion, and said tabular grains have an average aspect ratio of more than 1.2 and less than 5.0 and an average grain size of 0.3 μm to 0.6 μm.

2. The emulsion of claim 1, wherein said tabular grains have an average aspect ratio of not less than 1.5 and less than 4.5.

3. The emulsion of claim 2, wherein said tabular grains have an average aspect ratio of not less than 2.0 and less than 4.0.

4. A silver halide photographic light-sensitive material comprising a support having thereon a silver halide emulsion layer, wherein said silver halide emulsion layer comprises a silver halide photographic emulsion comprising silver halide grains formed under a condition that fine grains of silver halide substantially comprising twinned crystals are supplied into a protective colloid solution, in which said silver halide grains are formed, during a course of formation of said grains, and a sum of a projection area of tabular grains each having an aspect ratio larger than 1.2 accounts for not less than 50% of a total projection area of all silver halide grains of said emulsion, and said tabular grains have an average aspect ratio of more than 1.2 and less than 5,0 and an average grain size of 0.3 μm to 0.6 μm.

* * * * *